US005861848A

United States Patent [19]

Iwasaki

[11] Patent Number: 5,861,848

[45] Date of Patent: Jan. 19, 1999

[54] CIRCULARLY POLARIZED WAVE PATCH ANTENNA WITH WIDE SHORTCIRCUIT PORTION

[75] Inventor: Hisao Iwasaki, Tama, Japan

[73] Assignee: Kabushiki Kaisha Toshiba, Kawasaki, Japan

[21] Appl. No.: 492,362

[22] Filed: Jun. 19, 1995

[30] Foreign Application Priority Data

Jun. 20, 1994 [JP] Japan ..... 6-136992

[51] Int. Cl.[6] ..... H01Q 1/38

[52] U.S. Cl. ..... 343/700 MS; 343/769

[58] Field of Search ..... 343/700 MS, 769; H01Q 1/38, 13/08

[56] References Cited

U.S. PATENT DOCUMENTS 4,208,660 6/1980 McOwen ..... 343/769

5,410,749 4/1995 Siwiak et al. ..... 343/700 MS

OTHER PUBLICATIONS

N. Goto et al., "Ring Patch Antennas for Dual Frequency Use", IEEE AP–S digest, pp. 944–947 (1987).

Yasunaga et al., "Phased Array Antennas for Aeronautical Satellite Communications", I CAP'87, pp. 47–50 (1987).

*Primary Examiner*—Michael C. Wimer

*Attorney, Agent, or Firm*—Finnegan, Henderson, Farabow, Garrett & Dunner, L.L.P.

[57] ABSTRACT

A patch and a ground conductor are shortcircuited with two shortcircuit portions that are composed of conductive plates and that pass through a dielectric substrate. The shortcircuit portions are connected to the inner periphery of the patch and have large widths therealong. A first shortcircuit portion is disposed on a first line that connects a microstrip feeder line and the center point of the patch. A second shortcircuit portion is disposed on a second line that passes through the center point. The inner angle of the first line and the second line is in the range from 80 degrees to 110 degrees.

5 Claims, 26 Drawing Sheets

CIRCULARLY POLARIZED WAVE PATCH ANTENNA WITH WIDE SHORTCIRCUIT PORTION

BACKGROUND OF THE INVENTION

1. Field of the Invention

The present invention relates to a circularly polarized wave patch antenna for use with for example a mobile-satellite communication antenna.

2. Description of the Related Art

In upcoming array antennas, there will be various requirements for their performance such as beam scanning, beam forming, and low side lobing. To accomplish such requirements, active phased array antennas with LNA (low noise amplifier), HPA (high output amplifier), and a phase shifter are required. These array antenna are expected to be used for airplanes and automobiles. Thus, the array antennas including feeder circuits and so forth should be compactly and thinly formed.

In an L band mobile-satellite communication (transmission frequency=1.63 GHz, reception frequency=1.53 GHz), when signals are transmitted and received with the same antenna, a band width of 8% of frequencies for a transmission signal and a reception signal is required. When signals are transmitted and received with respective antennas, a band width of 1% of each base frequency for a transmission signal and a reception signal is required. When a signal is beamed to a stationary satellite, the signal should be scanned from the vertex by approximately 60 degrees. In the mobile-satellite communication, a circularly polarized wave antenna is also required.

When a band width of approximately 8% is accomplished for an antenna that transmits and receives signals and the dielectric constant of a dielectric substrate as a constructional member of the antenna is approximately 1.2, the thickness thereof becomes approximately 10 mm or greater. Thus, as the thickness of the substrate increases, the weight thereof also increases. Consequently, to reduce the thickness of the antenna, it is preferable to separate a transmission antenna and a reception antenna.

FIGS. 32*a* and 32*b* show an antenna that has a transmission antenna element and a reception antenna element according to a related art reference.

In FIGS. 32*a* and 32*b*, reference numerals 101 and 102 are layered dielectric substrates. A circular patch 103 is formed on the front surface of the dielectric substrate 101. A circle-annular patch 104 is formed between the dielectric substrates 101 and 102. A ground conductor 105 is formed on the rear surface of the dielectric substrate 102. A coaxial line 106 is connected from the rear surface of the dielectric substrate 102 to the patch 103 through the inside of the circle-annular patch 104. A coaxial line 107 is connected from the rear surface of the dielectric substrate 102 to the circle-annular patch 104. For example, the patches 103 and 104 are used for a transmission antenna element and a reception antenna element, respectively.

Particularly, in the antenna shown in FIGS. 32*a* and 32*b*, the antenna characteristics are deteriorated by the fringing effect of the axial line 106 that feeds a signal to the circular patch 103 against the circle-annular patch 104.

To prevent the fringing effect of the coaxial line 106 against the circle-annular patch 104, as shown in FIGS. 33*a* and 33*b*, the inner periphery of the circle-annular patch 104 is shortcircuited to the ground conductor 105 with a large number of pins 108.

The circle-annular patch 104 that is shortcircuited with the pins 108 has a larger radius than a conventional circular patch that accomplishes the same resonance frequency. Thus, when an array antenna is constructed of these antenna elements, if the element pitch necessary for a wide angle beam scanning operation is around a half-wave length, the pitch of these antenna elements is too small and thereby they cannot be properly isolated. Consequently, such an array antenna cannot provide desired antenna characteristics.

An antenna that can generate a circularly polarized wave with one point feeding has been proposed. FIGS. 34*a* and 34*b* shows the construction of this antenna. The antenna shown in FIGS. 34*a* and 34*b* comprises a circular patch 110, a ground conductor 111, a feeder line 112, and shortcircuit pins 113 and 114. It is known that the angle of the shortcircuit pin 114 and the feeder line 112 should be approximately 70 degrees to generate a circularly polarized wave in this construction. As shown in FIGS. 32*a* and 32*b* and 33*a* and 33*b*, to layer a circular patch antenna element on another antenna element, a feeder line that passes through the inside the circular patch 110 is required. In this construction, a current that flows in the circular patch 110 adversely affects the feeder line, thereby deteriorating the circularly polarized wave characteristics of the layered circular patch.

SUMMARY OF THE INVENTION

The present invention is made from the above-described point of view.

A first object of the present invention is to provide an antenna that can be compactly and thinly constructed in comparison with a conventional antenna.

A second object of the present invention is to provide an array antenna with a high isolation between each circularly polarized wave antenna element so as to improve the overall performance of the antenna.

A third object of the present invention is to provide an antenna that suppresses the fringing effect of a coaxial line that feed a signal to a circular patch against a circle-annular patch.

A fourth object of the present invention is to provide an antenna that can be easily fabricated without need to accurately align an inner core of a coaxial line that feeds a signal to a circular patch with a shortcircuit portion that shortcircuits a circle-annular patch and a ground conductor.

A fifth object of the present invention is to provide an antenna that can be constructed of a reduced number of constructional portions so as to remarkably reduce the fabrication cost thereof.

A first aspect of the present invention is an antenna, comprising a dielectric substrate, an annular patch formed on a first surface of the dielectric substrate, a ground conductor formed on a second surface of the dielectric substrate, a feeder portion for feeding a signal to a first position of the annular patch, a first shortcircuit portion connected between a second position and the ground conductor, the second position placed on the inner periphery of the annular patch and on a first line that connects the center point of the annular patch and the first position, and the first shortcircuit portion having an electrically large width along the inner periphery of the annular patch, and a second shortcircuiting portion connected between a third position on the inner periphery of the annular patch and the ground conductor and having an electrically large width along the inner periphery of the annular patch.

A second aspect of the present invention is an antenna, comprising a dielectric substrate composed of a laminate of a plurality of substrate members, a first patch formed on a first surface of the dielectric substrate, a second patch annularly formed on a first laminate surface of the dielectric substrate, a ground conductor formed on a second surface of the dielectric substrate, a first feeder portion for feeding a signal to a first position of the second patch, a first shortcircuit portion connected between a second position on the inner periphery of the second patch and the ground conductor on a first line that connects the center position of the second patch and the first position and having an electrically large width along the inner periphery of the second patch, a second shortcircuit portion connected between a third position on the inner periphery of the second patch and the ground conductor and having an electrically large width along the inner periphery of the second patch, and a second feeder portion connected to the first patch and adapted for feeding a signal to a fourth position at least on the first line and a second line that connects the center point and the third position.

According to the present invention, the shortcircuit portion has a large width. Thus, by decreasing the inner angle or the width thereof, the resonance frequency can be decreased without need to increase the diameter or thickness of the patch. Consequently, according to the present invention, the size and thickness of the antenna can be reduced in comparison with the conventional antenna.

In addition, when the present invention is applied for an array antenna, the isolation between each circularly polarized wave antenna element can be improved. Thus, the entire performance of the array antenna can be improved.

Moreover, according to the present invention, since a shortcircuit portion with a large width is disposed between a feeder portion for a first patch and a second patch disposed adjacent to the first patch, the fringing effect of the feeder portion against the second patch can be suppressed.

Furthermore, according to the present invention, since a shortcircuit portion of the antenna has a large width, the antenna can be easily fabricated without need to precisely align a feeder portion for a first patch with another feeder portion for a second patch.

These and other objects, features and advantages of the present invention will become more apparent in light of the following detailed description of best mode embodiments thereof, as illustrated in the accompanying drawings.

DESCRIPTION OF THE PREFERRED EMBODIMENTS

Next, with reference to the accompanying drawings, embodiments of the present invention will be described.

Figure 1:
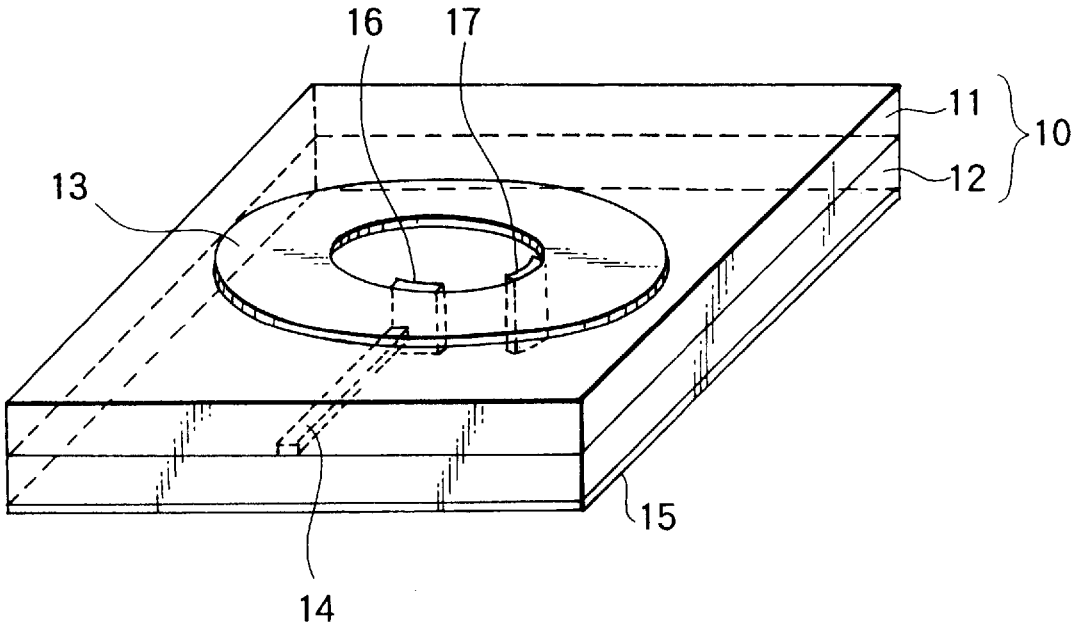
FIG. 1 is a perspective view showing a circularly polarized wave patch antenna according to a first embodiment of the present invention.
Figure 2:
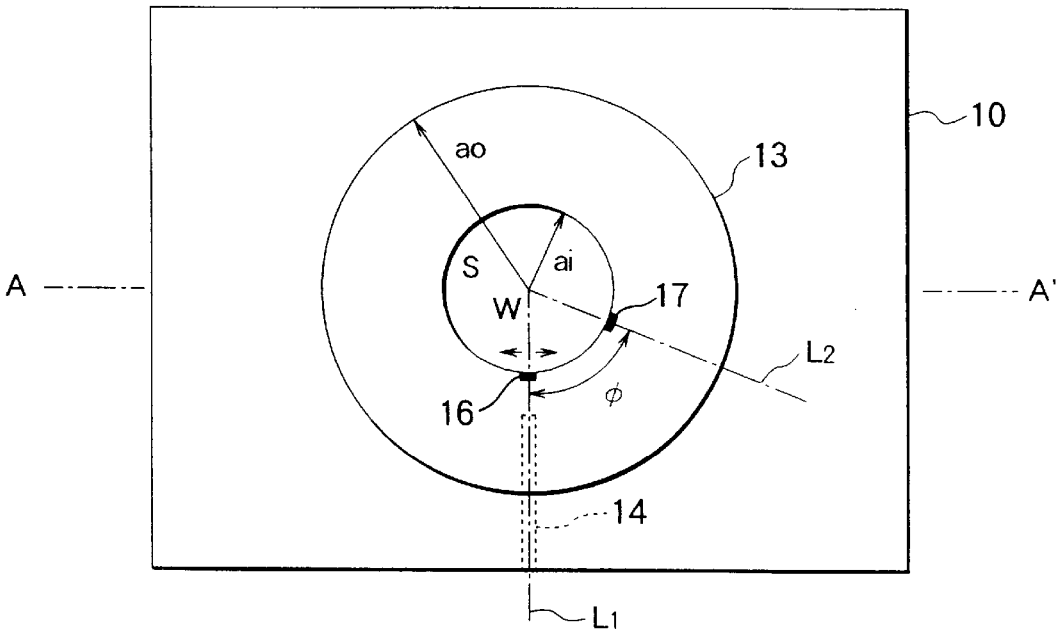
FIG. 2 is a plan view of FIG. 1.
Figure 3:
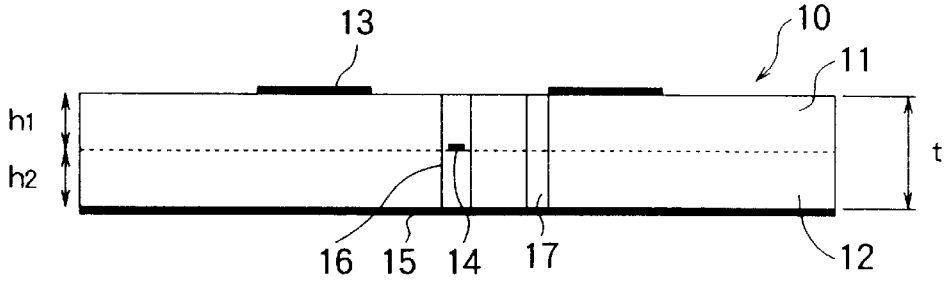
FIG. 3 is a side view from a $L_1$ side of FIG. 2.

FIG. 1 is a perspective view showing a circularly polarized patch antenna according to a first embodiment of the present invention. FIG. 2 is a plan view of FIG. 1. FIG. 3 is a side view from a $L_1$ side of FIG. 2.

In FIGS. 1 to 3, reference numeral 10 is a dielectric substrate. The dielectric substrate 10 is constructed of a laminate of a first dielectric substrate member 11 and a second dielectric substrate member 12. The thickness of the first dielectric substrate member 11 is denoted by $h_1$. The thickness of the second dielectric substrate member 12 is denoted by $h_2$. The thickness of the dielectric substrate 10 is denoted by t ($=h_1+h_2$). The dielectric constant of each of the first dielectric substrate member 11 and the second dielectric substrate member 12 is $\epsilon r$.

A circle-annular patch 13 is disposed on the front surface of the first dielectric substrate member 11. The circle-annular patch 13 is composed of a conductive plate. The outer diameter and the inner diameter of the patch 13 are denoted by $a_o$ and $a_i$, respectively.

A microstrip feeder line 14 is disposed between the first dielectric substrate member 11 and the second dielectric substrate member 12. The microstrip feeder line 14 extends from one edge of the dielectric substrate 10 to almost a center point of the outer periphery and the inner periphery of the patch 13 toward a center point S of the patch 13. It should be noted that a coaxial line or the like can be used instead of the microstrip feeder line 14.

A ground conductor 15 is disposed on the rear surface of the second dielectric substrate member 12.

The patch 13 and the ground conductor 15 are shortcircuited by two shortcircuit portions 16 and 17. The shortcircuit portions 16 and 17 pass through the dielectric substrate 10. The shortcircuit portions 16 and 17 are composed of conductive plates. The shortcircuit portions 16 and 17 are connected to the inner periphery of the patch 13. The shortcircuit portions 16 and 17 have large widths along the inner periphery of the patch 13. The widths of the shortcircuit portions 16 and 17 are denoted by W. The shortcircuit portion 16 is disposed on a line $L_1$ that connects the microstrip feeder line 14 and the center point S of the patch 13. The shortcircuit portion 17 is disposed on a line $L_2$ that passes through the center point S. The inner angle of the line $L_1$ and the line $L_2$ is denoted by $\phi$.

The circularly polarized patch antenna generates a circularly polarized wave by the composition of a current distribution along the line $L_1$ and a current distribution along the line $L_2$. In the circularly polarized wave patch antenna according to this embodiment, when the inner angle $\phi$ of the line $L_1$ and the line $L_2$ is in the range from 80 degrees to 110 degrees, it is not necessary to consider the deterioration of the electrical characteristics of the circularly polarized wave. In addition, the resonance frequency can be controlled corresponding to the width w. In other words, when the width W is decreased, the resonance frequency can be decreased. When the width W is increased, the resonance frequency can be increased. This is because the shortcircuit portions 16 and 17 have large widths along the inner periphery of the patch 13. Conventionally, when the resonance frequency is decreased, the diameter of the patch should be increased. In contrast, according to the present invention, when the width W is decreased, the resonance frequency can be decreased without need to increase the diameter of the patch 13. Thus, according to the present invention, the size and thickness of the antenna can be decreased in comparison with the conventional antenna.

To observe the effects of the present invention, the circularly polarized wave characteristics of the antenna shown in FIGS. 1 to 3 were measured in the following conditions.

Figure 4:
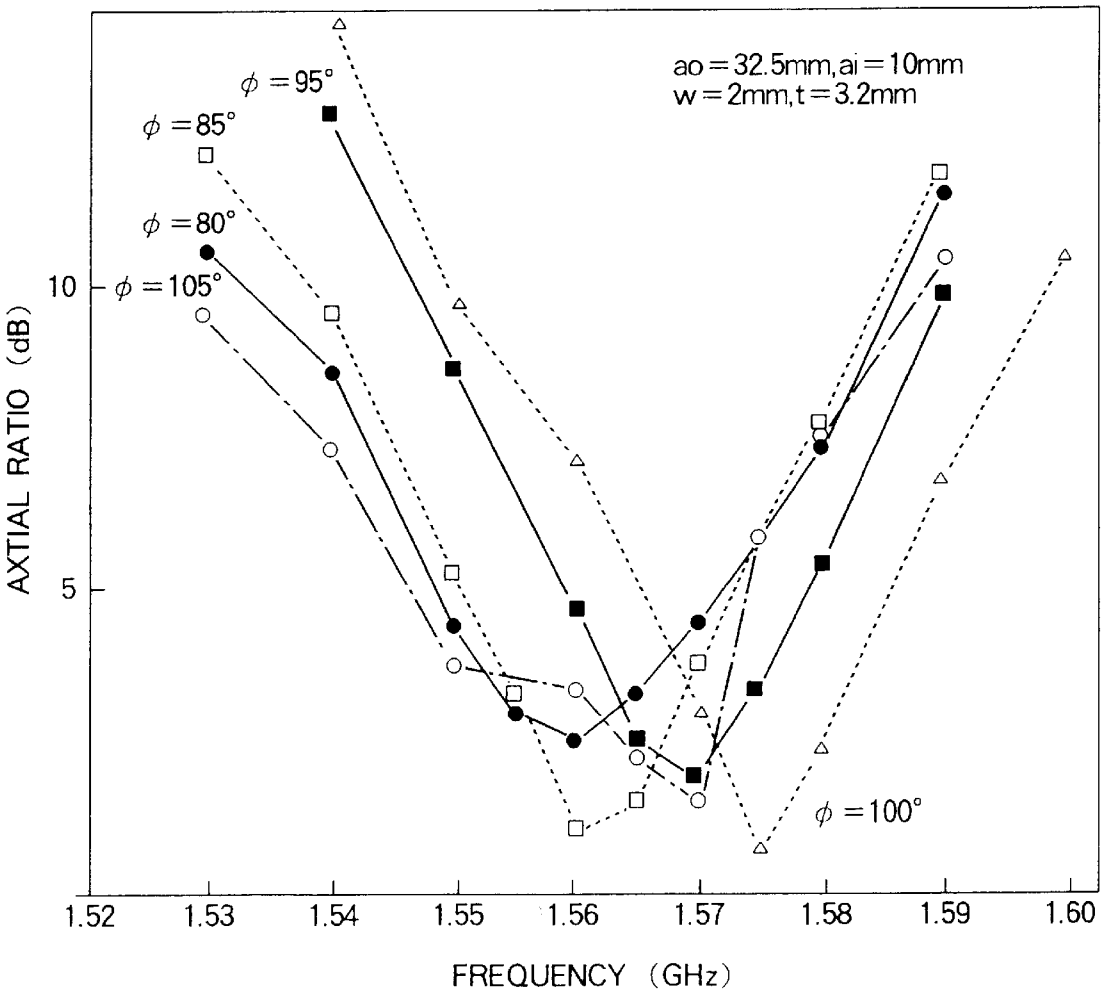
FIG. 4 is a graph showing a first example of circularly polarized wave characteristics of the circularly polarized wave patch antenna of FIGS. 1 to 3.

Patch 13:

Outer diameter $a_o$=32.5 mm
Inner diameter $a_i$=10 mm
Dielectric constant=2.6
Thickness t=3.2 mm FIG. 4 shows the case of shortcircuit width W=2 mm.

Figure 5:
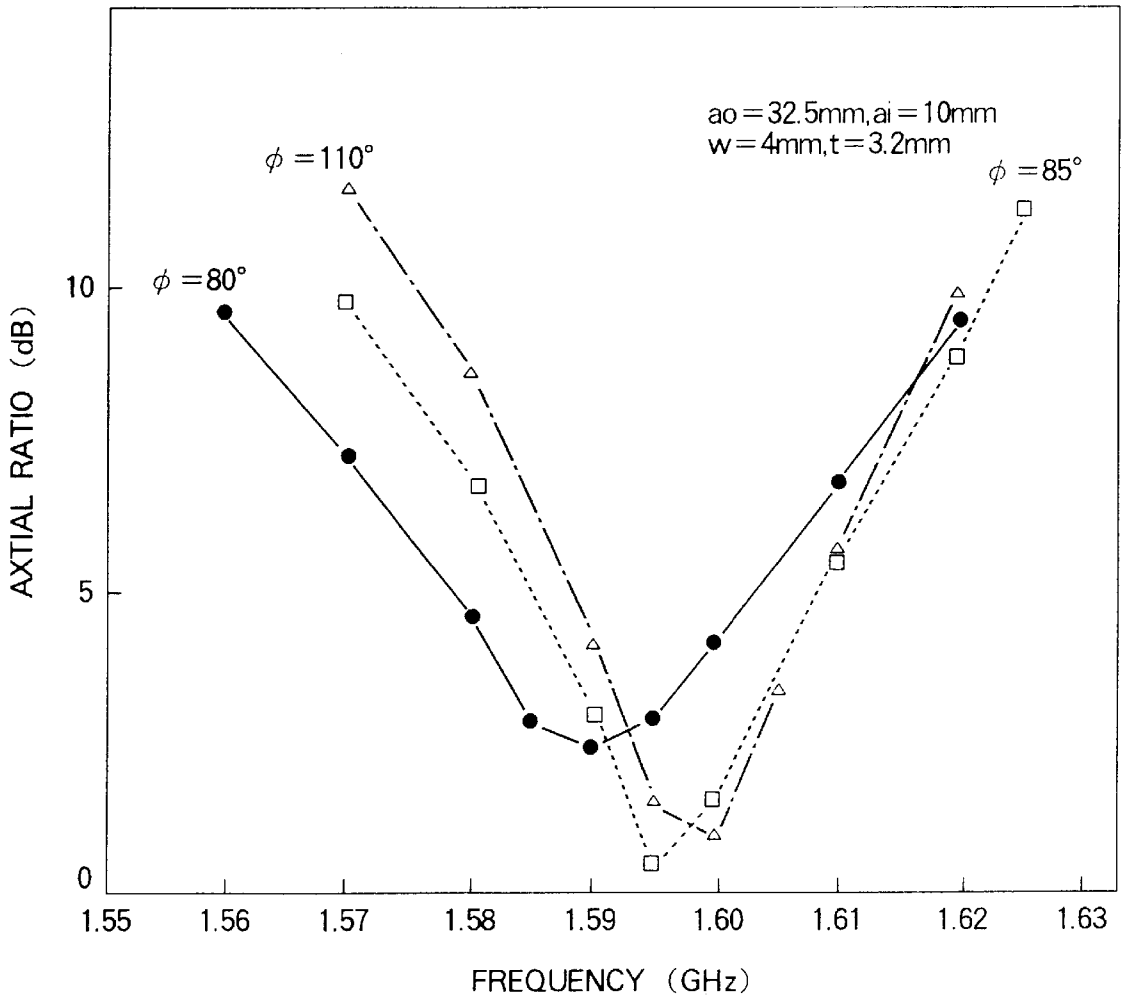
FIG. 5 is a graph showing a second example of the circularly polarized wave characteristics of the circularly polarized wave patch antenna of FIGS. 1 to 3.

FIG. 5 shows the case of shortcircuit width W=4 mm.

Figure 6:
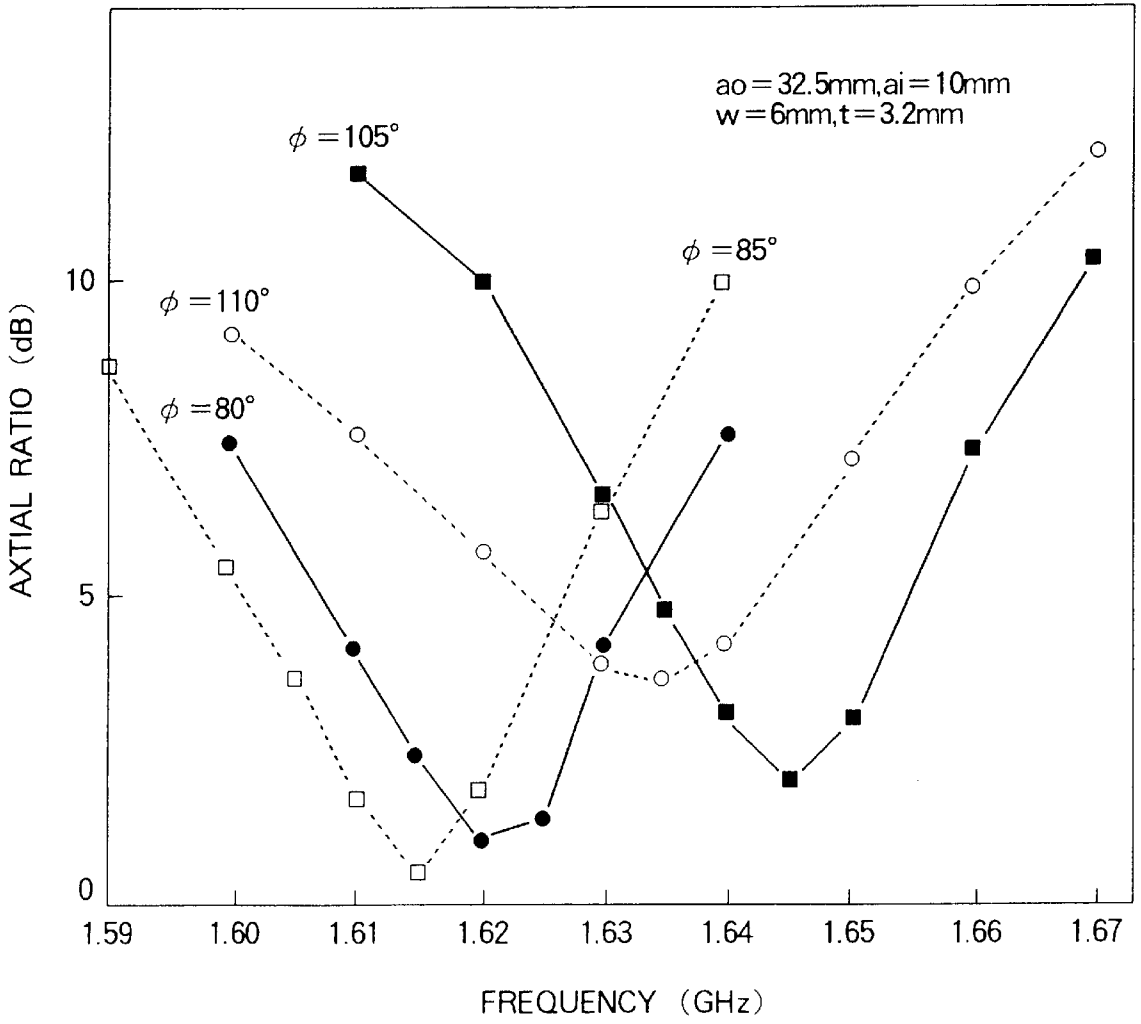
FIG. 6 is a graph showing a third example of the circularly polarized wave characteristics of the circularly polarized wave patch antenna of FIGS. 1 to 3.

FIG. 6 shows the case of shortcircuit width W=6 mm.

As is clear from FIGS. 4 to 6, when the inner angle $\phi$ is in the range from 80 degrees to 110 degrees, good circularly polarized wave characteristics are obtained. In particular, it is clear that at $\phi$=85 degrees, a good circularly polarized wave with an axial ratio of 1 dB or less is accomplished. To accomplish the same axial ratio with the conventional antennas, the inner angle $\phi$ should be 70 degrees.

As the widths W of the shortcircuit portions 16 and 17 are increased to 2 mm to 6 mm, the frequencies of the circularly polarized waves are increased.

Figure 7:
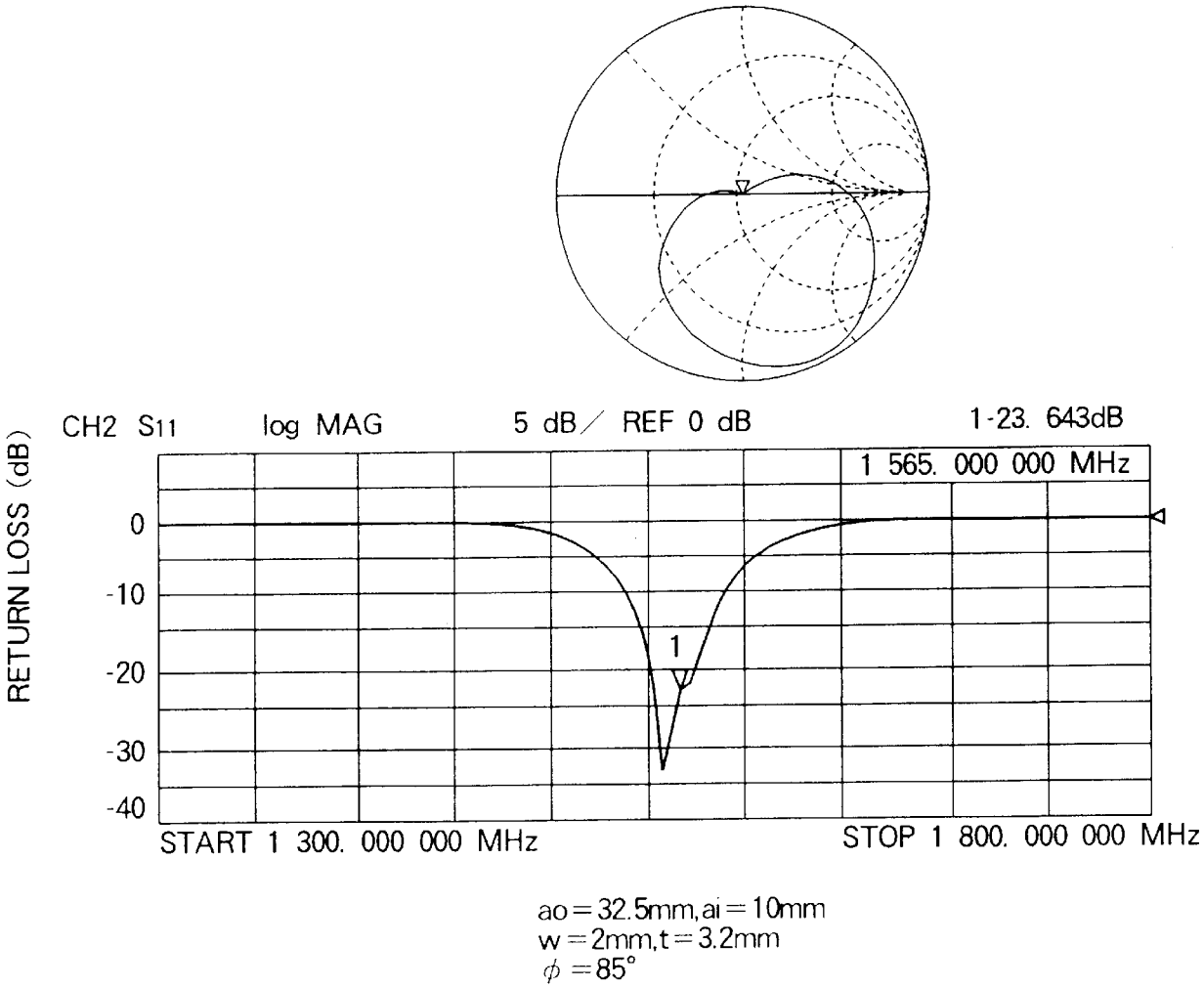
FIG. 7 is a graph showing input impedance characteristics of the circularly polarized wave characteristics of the circularly polarized wave patch antenna of FIGS. 1 to 3.
Figure 8:
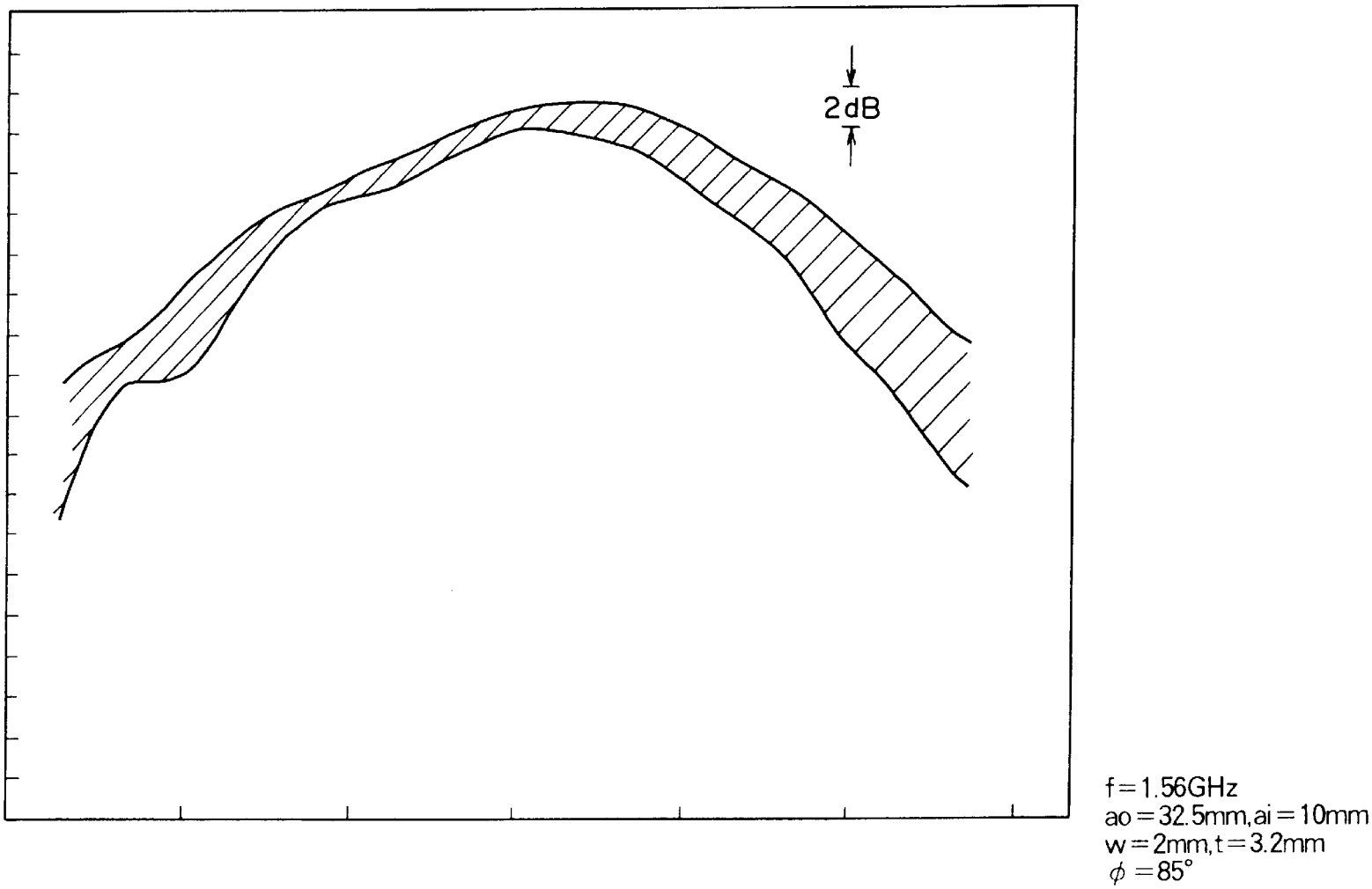
FIG. 8 is a graph showing a radiative directivity of the circularly polarized wave patch antenna of FIGS. 1 to 3.

FIG. 7 shows an input impedance in the conditions of W=2 mm and $\phi$=85 degrees. At a frequency of which a circularly polarized wave is obtained, a good return loss of −25 dB is obtained. FIG. 8 shows a radiation directivity at a frequency of 1.56 GHz.

As described above, according to this embodiment, a one-point feeding type circularly polarized wave antenna can be thinly and compactly constructed in comparison with the conventional antenna. The antenna according to this embodiment has good circularly polarized characteristics when the inner angle $\phi$ of the line $L_1$ and $L_2$ is in the range from 80 degrees to 110 degrees.

Figure 9:
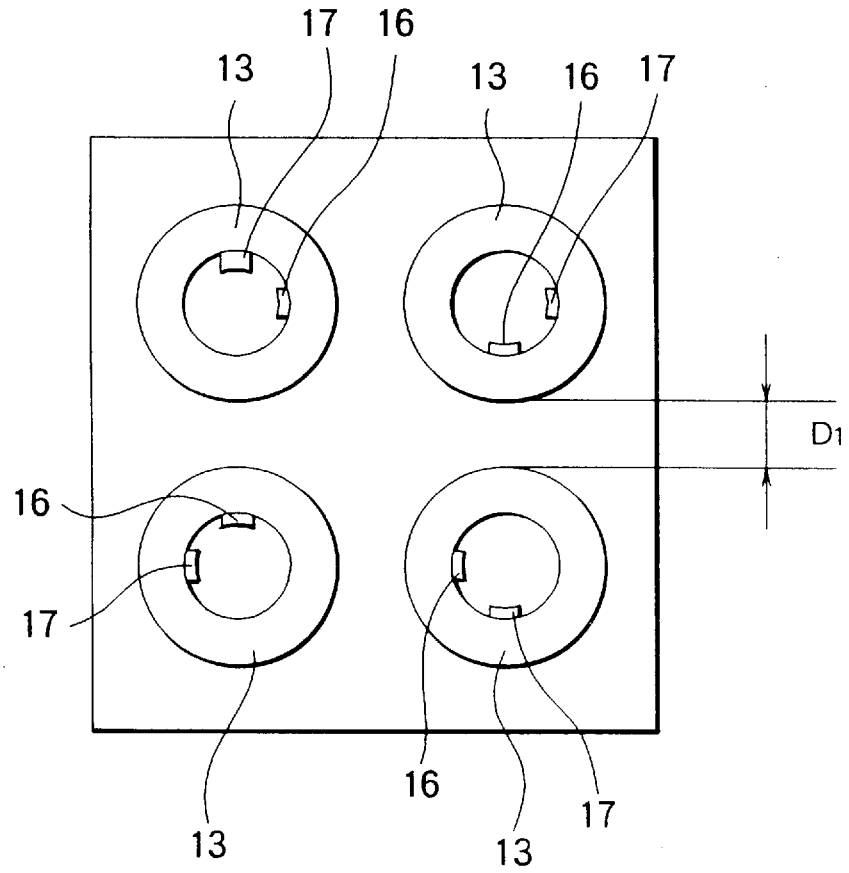
FIG. 9 is a plan view showing an array antenna of which the circularly polarized wave antennas of FIGS. 1 to 3 are arrayed.

FIG. 9 is a plan view showing an array antenna of which the circularly polarized wave antennas shown in FIGS. 1 to 3 are arrayed.

In the array antenna shown in FIG. 9, the four circularly polarized wave antennas shown in FIGS. 1 to 3 are arrayed. The pitch between each adjacent circularly polarized wave antenna is denoted by $D_1$. Since the circularly polarized wave antenna shown in FIGS. 1 to 3 can be compactly constructed in comparison with the conventional antenna, $D_1$ can be widened. Thus, when the present invention is applied for an array antenna, the isolation between each circularly polarized wave antenna (patch 13) can be improved. Consequently, the performance of the entire array antenna can be improved.

Figure 10:
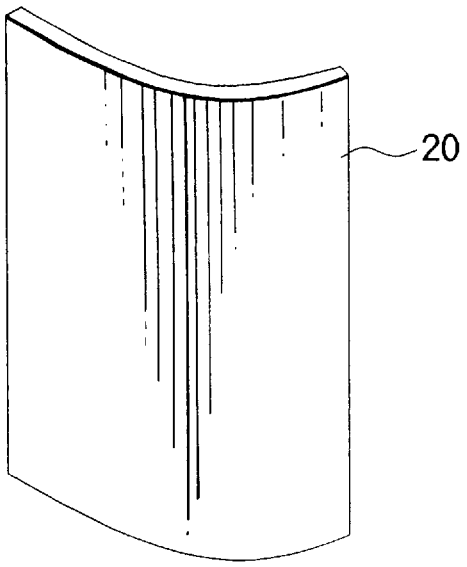
FIG. 10 is a perspective view showing a wide shortcircuit portion according to the present invention.
Figure 11:
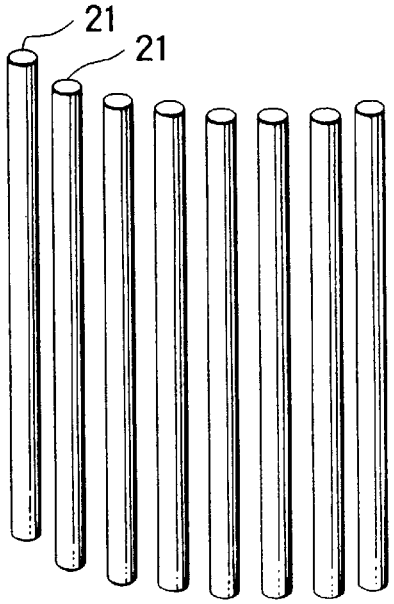
FIG. 11 is a perspective view showing a wide shortcircuit portion according to the present invention.
Figure 12:
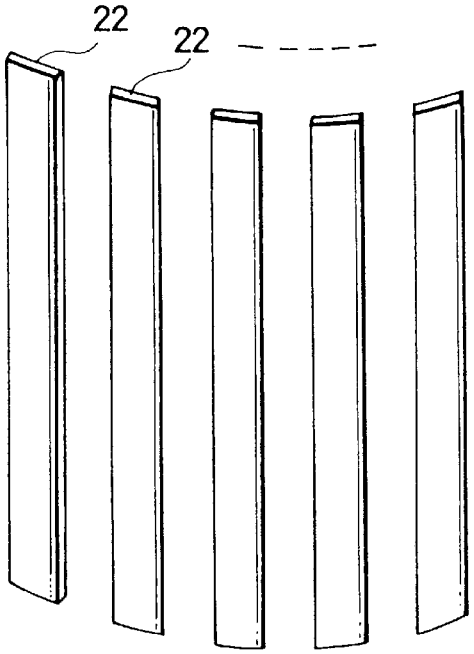
FIG. 12 is a perspective view showing a wide shortcircuit portion according to the present invention.

FIG. 10 is an enlarged perspective view showing each of the shortcircuit portions 16 and 17 shown in FIGS. 1 to 3. In FIG. 10, each of the shortcircuit portions 16 and 17 is composed of a conductive plate. However, it should be noted that each of the shortcircuit portions according to the present invention may be composed of a plurality of through-holes 21, 21, . . . as shown in FIG. 11. Alternatively, each of the shortcircuit portions according to the present invention may be composed of a plurality of conductive plates 22, 22, . . . as shown in FIG. 12. In other words, as a necessary condition, each of the shortcircuit portions according to the present invention should have an electrically large width.

Next, a second embodiment of the present invention will be described.

Figure 13:
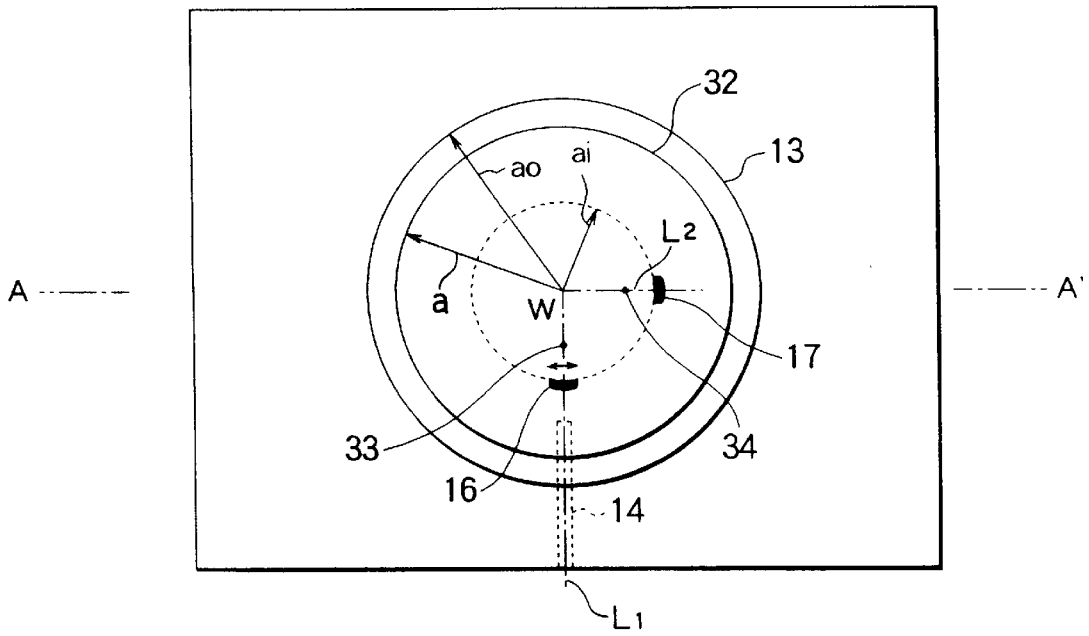
FIG. 13 is a plan view showing a circularly polarized patch antenna according to a second embodiment of the present invention.
Figure 14:
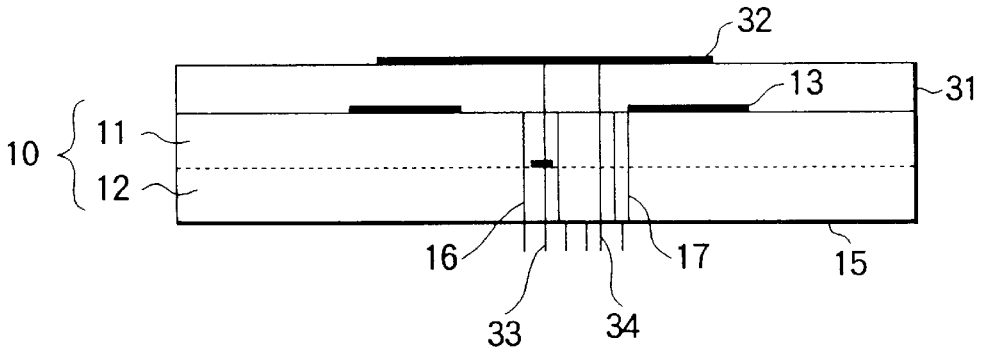
FIG. 14 is a side view from a $L_1$ side of FIG. 13.

FIG. 13 is a plan view showing a circularly polarized wave patch antenna according to the second embodiment of the present invention. FIG. 14 is a side view from a $L_1$ side of FIG. 13.

The circularly polarized wave patch antenna shown in FIGS. 13 and 14 is constructed by layering a third dielectric substrate member 31 on the circularly polarized wave patch antenna shown in FIGS. 1 to 3. In addition, a circular patch 32 is disposed on the front surface of the third dielectric substrate member 31. The patch 32 is coaxial to the patch 13. The outer diameter of the patch 32 is denoted by a. In this case, the relation of $a_o<a<a_i$ is satisfied. Two coaxial lines 33 and 34 extend from the rear surface of the dielectric substrate member 12 to the patch 32 through the dielectric substrates 10 and 31, respectively. Thus, in this embodiment, signals are fed to two points of the patch 32. The coaxial line 33 is connected to the patch 32 at an inner position of the inner periphery of the patch 13 on the line $L_1$. The coaxial line 34 is connected to the patch 32 at an inner position of the inner periphery of the patch 13 on the line $L_2$. Two signals are fed to two points with a phase difference of 90 degrees of the patches 13 and 32 and thereby a circularly polarized wave is accomplished.

The circularly polarized wave patch antenna is used for a system with for example different bands of a transmission frequency and a reception frequency. In this system, for example the patch 32 is used for a transmission antenna and the patch 13 is used for a reception antenna.

The circularly polarized patch antenna according to this embodiment has the same effects as the circularly polarized wave patch antenna shown in FIGS. 1 to 3. In addition, in the circularly polarized wave patch antenna according to this embodiment, the fringing effect of the coaxial lines 33 and 34 that feed signals to the patch 32 against the patch 13 can be suppressed. This is because the wide shortcircuit portions 16 and 17 are disposed between the coaxial lines 33 and 34 and the patch 13 disposed adjacent thereto. Moreover, since each of the shortcircuit portions 16 and 17 has a large width, the circularly polarized patch antenna according to this embodiment can be easily fabricated without need to precisely align the coaxial lines 33 and 34 with the shortcircuit portions 16 and 17.

It should be noted that the present invention is not limited to the above-described embodiments.

Figure 15A:
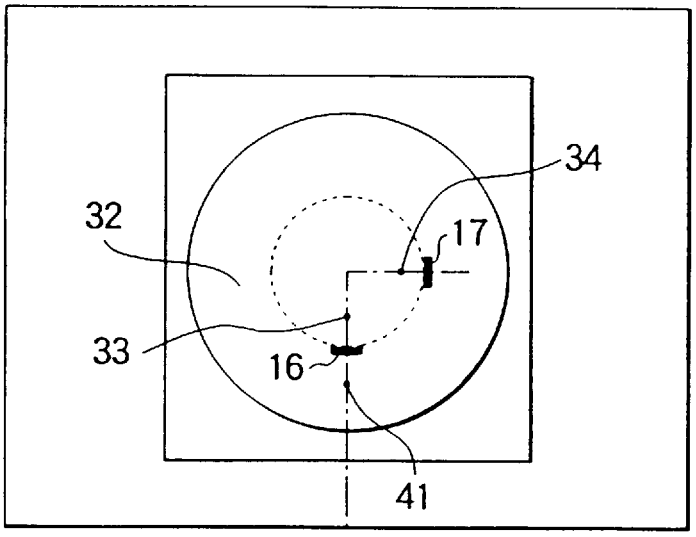
FIGS. 15*a* and 15*b* are a plan view and a vertical sectional view, respectively, showing a first modification of FIG. 13.
Figure 15B:
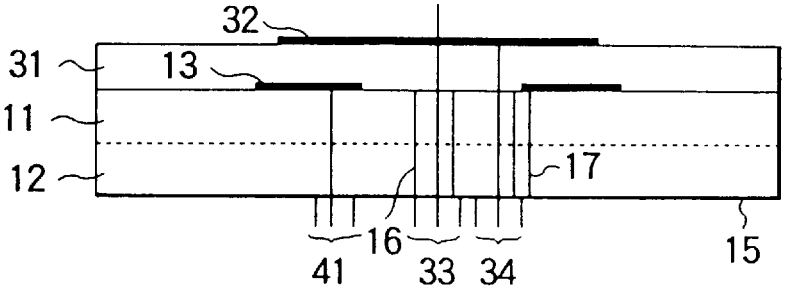

For example, as shown in FIGS. 15*a* and 15*b*, a signal may be fed by a coaxial line 41 instead of the microstrip feeder line 14.

Figure 16A:
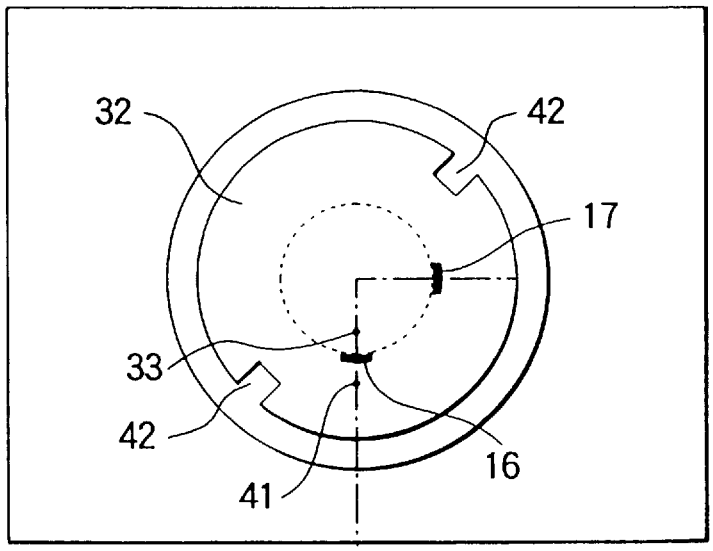
FIGS. 16*a* and 16*b* are a plan view and a vertical sectional view, respectively, showing a second modification of FIG. 13.
Figure 16B:
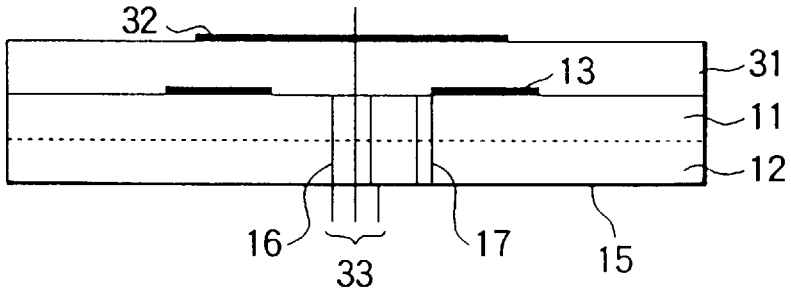

Alternatively, as shown in FIGS. 16*a* and 16*b*, a signal is fed to one point of the patch 32. In addition, a notch 42 is formed at a predetermined position on the outer periphery of the patch 32 and a degenerated device is disposed therein so as to accomplish a circularly polarized wave antenna.

For example, the shapes of the patches according to the present invention are not limited to circle-annular and circular. Instead, the shapes of the patches according to the present invention may be rectangular, square, elliptic, and the like. In addition, the inner shape and outer shape of the patches are not limited to those described in the embodiments. Moreover, instead of the microstrip line that feeds a signal to the circle-annular patch, a conventional feeder method such as a coaxial line, a slot coupling method, or the like can be used.

As with the case shown in FIG. 9, the circularly polarized wave antenna shown in FIGS. 13 and 14 may be used for an array antenna. In this case, the array antenna has the same effects as that shown in FIG. 9.

Next, a third embodiment of the present invention will be described.

Figure 17:
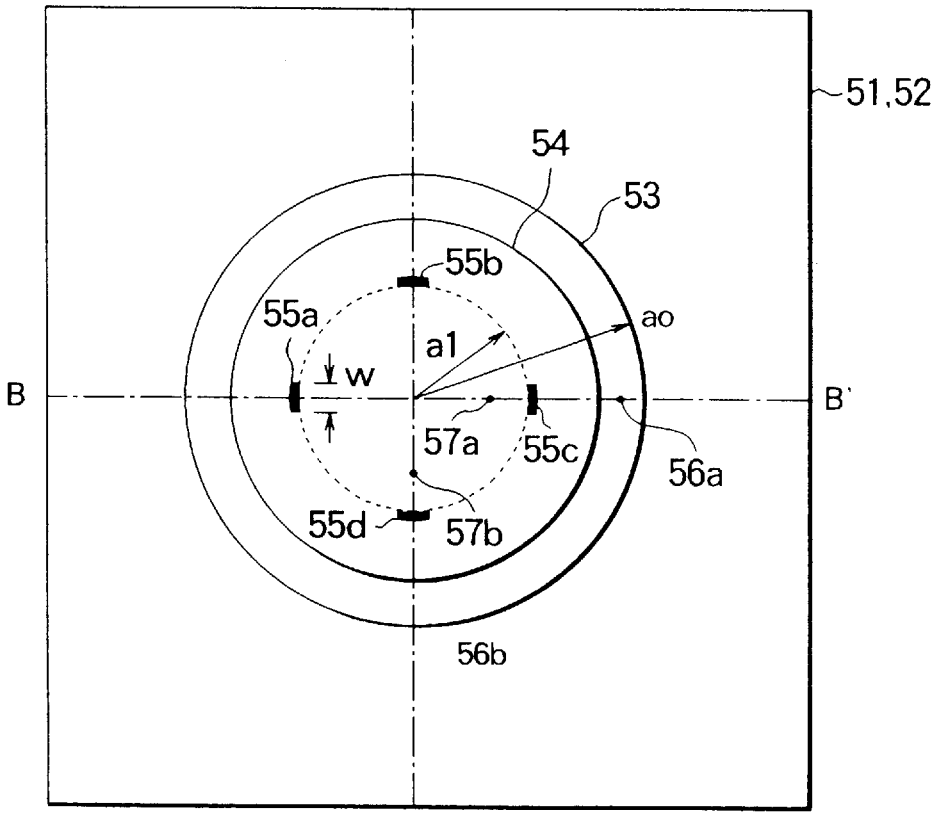
FIG. 17 is a plan view showing a circularly polarized wave patch antenna according to a third embodiment of the present invention.
Figure 18:
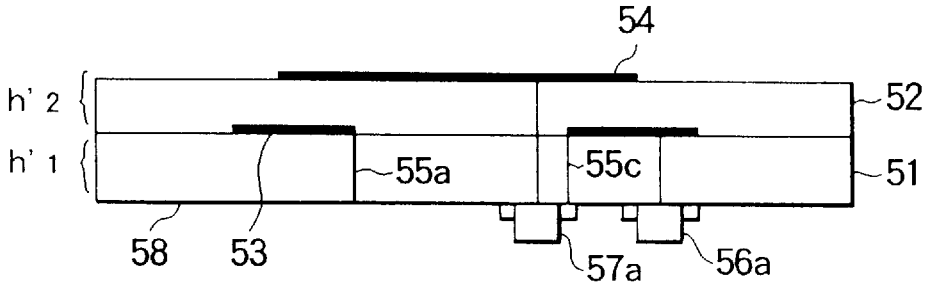
FIG. 18 is a vertical sectional view taken along line B–B' of FIG. 17.

FIG. 17 is a plan view showing a circularly polarized wave antenna according to the third embodiment of the present invention. FIG. 18 is a vertical sectional view taken along line B–B' of FIG. 17.

In FIGS. 17 and 18, reference numerals 51 and 52 are dielectric substrate members with thicknesses $h'_1$ and $h'_2$, respectively. Reference numeral 53 is a circle-annular patch composed of a conductive plate and having an outer diameter of $a'_o$ and an inner diameter of $a'_i$. Reference numeral 54 is a circular patch layered on the circle-annular patch 53. Reference numeral 58 is a ground conductor. Reference numerals 55*a* to 55*d* are shortcircuit portions that shortcircuit the circle-annular patch 53 and the ground conductor 58. Each of the shortcircuit portions 55*a* to 55*d* is composed of a conductor with a width W. Reference numerals 56*a* and 56*b* are coaxial lines that feed signals to the circle-annular patch antenna 53. Reference numerals 57*a* and 57*b* are coaxial lines that feed signals to the circular patch antenna 54.

Next, the operation of the antenna according to this embodiment will be described.

Figure 19:
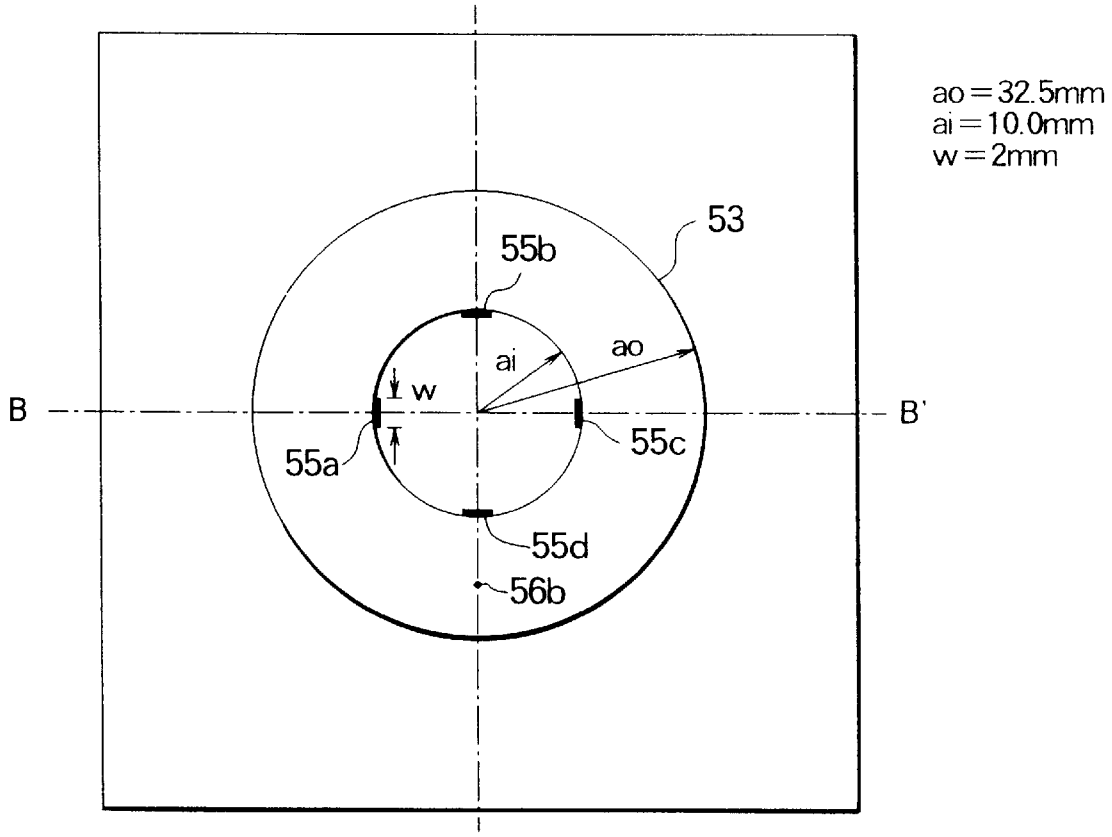
FIG. 19 is a plan view showing the construction of a circle-annular patch of the circularly polarized wave circle-annular patch antenna of FIG. 17.
Figure 20:
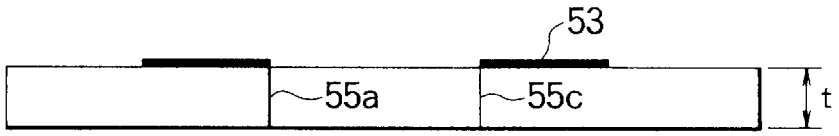
FIG. 20 is a vertical sectional view taken along line B–B' of FIG. 19.
Figure 21:
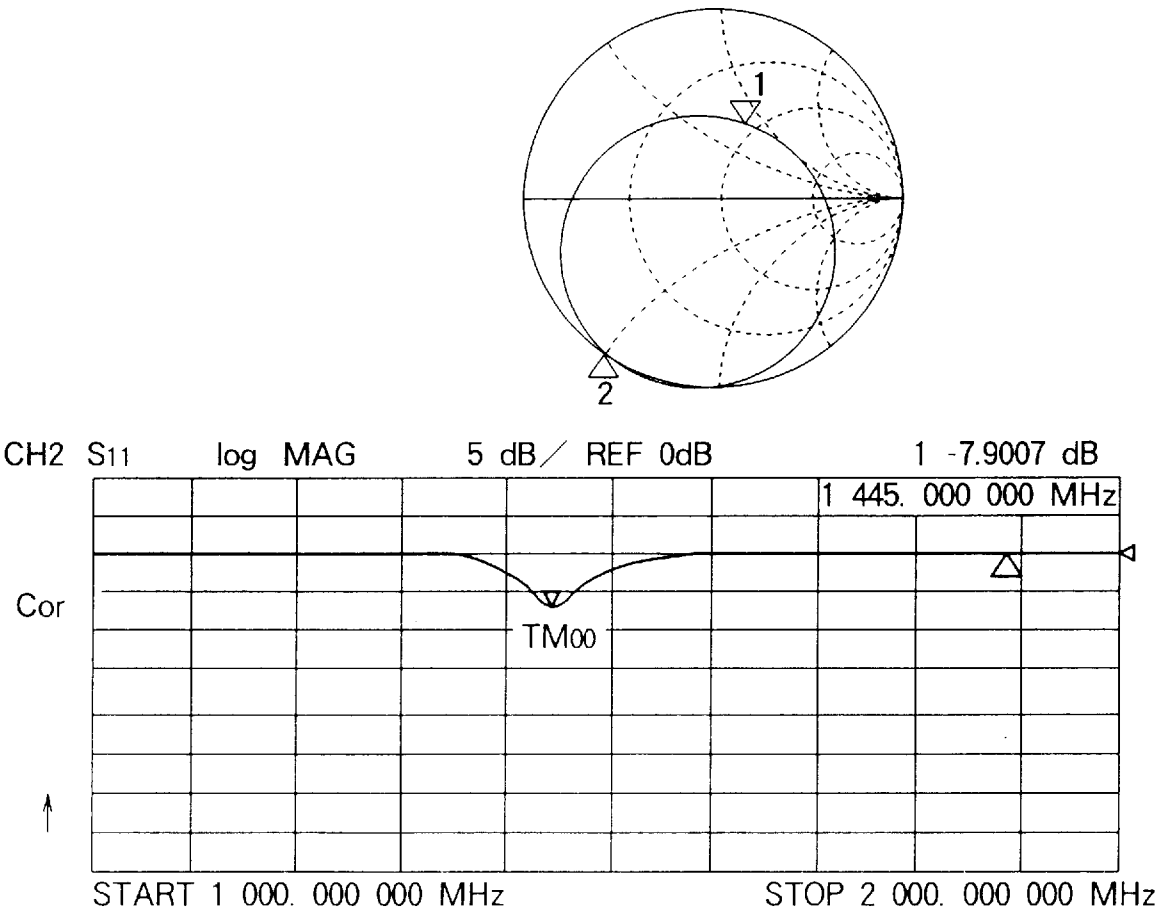
FIG. 21 is a graph showing a first example of circularly polarized wave characteristics of the circle-annular patch antenna of FIG. 17.

FIGS. 19 and 20 show the circle-annular patch antenna 53 and the coaxial feeder line 56*b*. FIG. 21 shows the resonance frequency of the circle-annular patch antenna in the conditions of dielectric factor=2.6, thickness of dielectric substrate=3.2 mm, outer diameter $a_o$=32.5 mm, and inner diameter $a_i$=10.0 mm. FIG. 19 is a plan view of the circle-annular patch antenna 53. FIG. 20 is a vertical sectional view taken along line B–B' of FIG. 19. In this case, the resonance frequency is 1.445 GHz. By adjusting the feed points, the impedance thereof can be matched.

Figure 22:
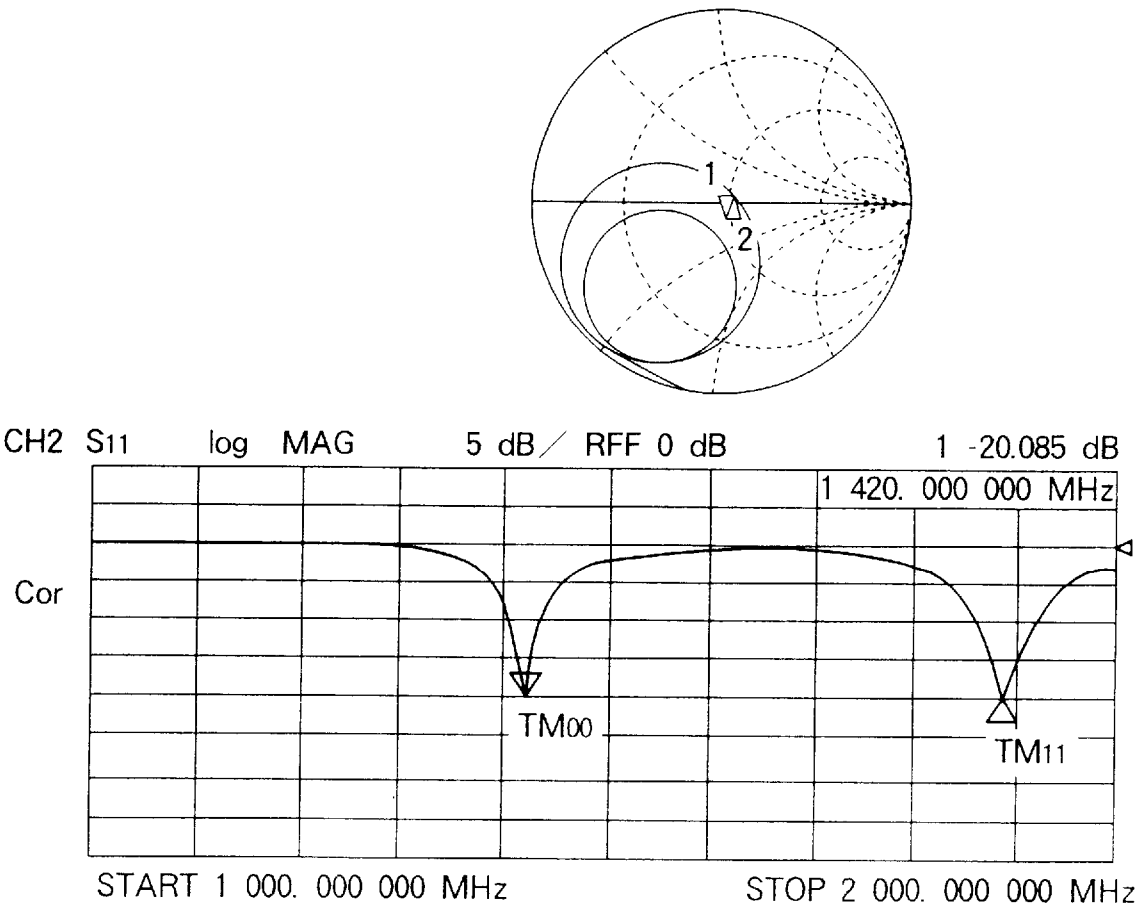
FIG. 22 is a graph showing a second example of the circularly polarized wave characteristics of the circle-annular patch antenna of FIG. 17.

FIG. 22 shows resonance frequencies in the case that the conductor of the patch radiator inside the circle-annular patch antenna 53 is fully shortcircuited to the ground conductor 58. Although there are two resonance frequencies, the lower frequency is a resonance frequency in $TM_{00}$ mode and the higher frequency (1.89 GHz) is a resonance frequency in dominant mode $TM_{11}$ that is used for the conventional circle-annular patch antenna. Thus, it is clear that when the shortcircuit portion is fully shortcircuited to the ground conductor, even if the outer diameter is the same, the resonance frequency is increased by approximately 1.3 times.

As described above in the section of the related art reference, when the shortcircuit portion is shortcircuited to the ground conductor, the resonance frequency is increased and thereby the gain is increased. However, the size of the antenna becomes larger than that of the conventional circular patch antenna. Thus, when the antennas are arrayed, due to the restriction of the pitch between each antenna element, it is difficult to perform the wide angle beam scanning operation. However, when the ratio of the inner diameter and outer diameter of the circle-annular patch antenna is changed, the resonance frequency can be decreased and the size of the antenna can be decreased. Nevertheless, the gain of the antenna is decreased. Between the above-described two constructions, the conventional circular patch antenna is positioned.

Figure 23:
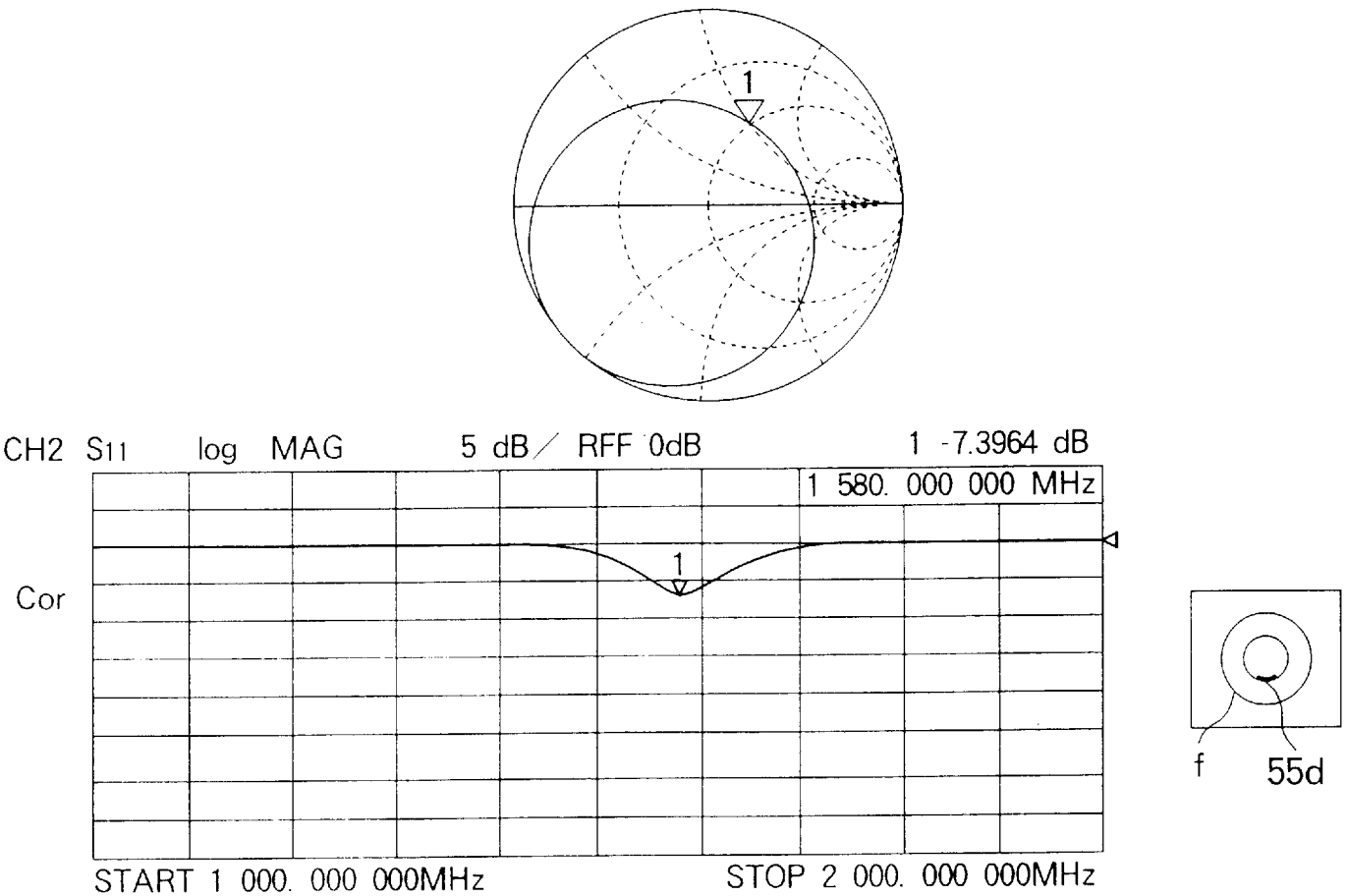
FIG. 23 is a graph showing a third example of the circularly polarized wave characteristics of the circle-annular patch antenna of FIG. 17.
Figure 24:
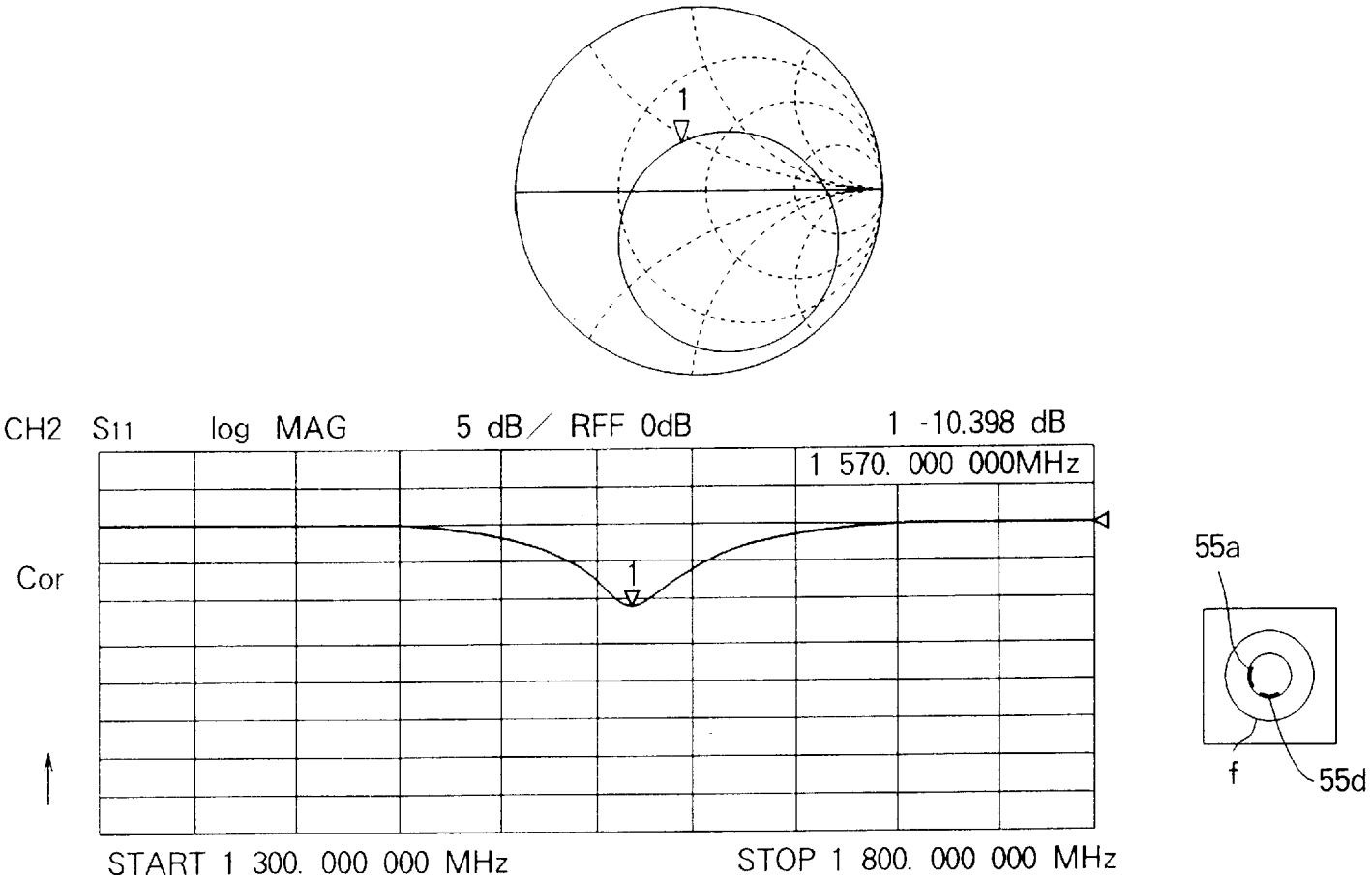
FIG. 24 is a graph showing a fourth example of the circularly polarized wave characteristics of the circle-annular patch antenna of FIG. 17.
Figure 25:
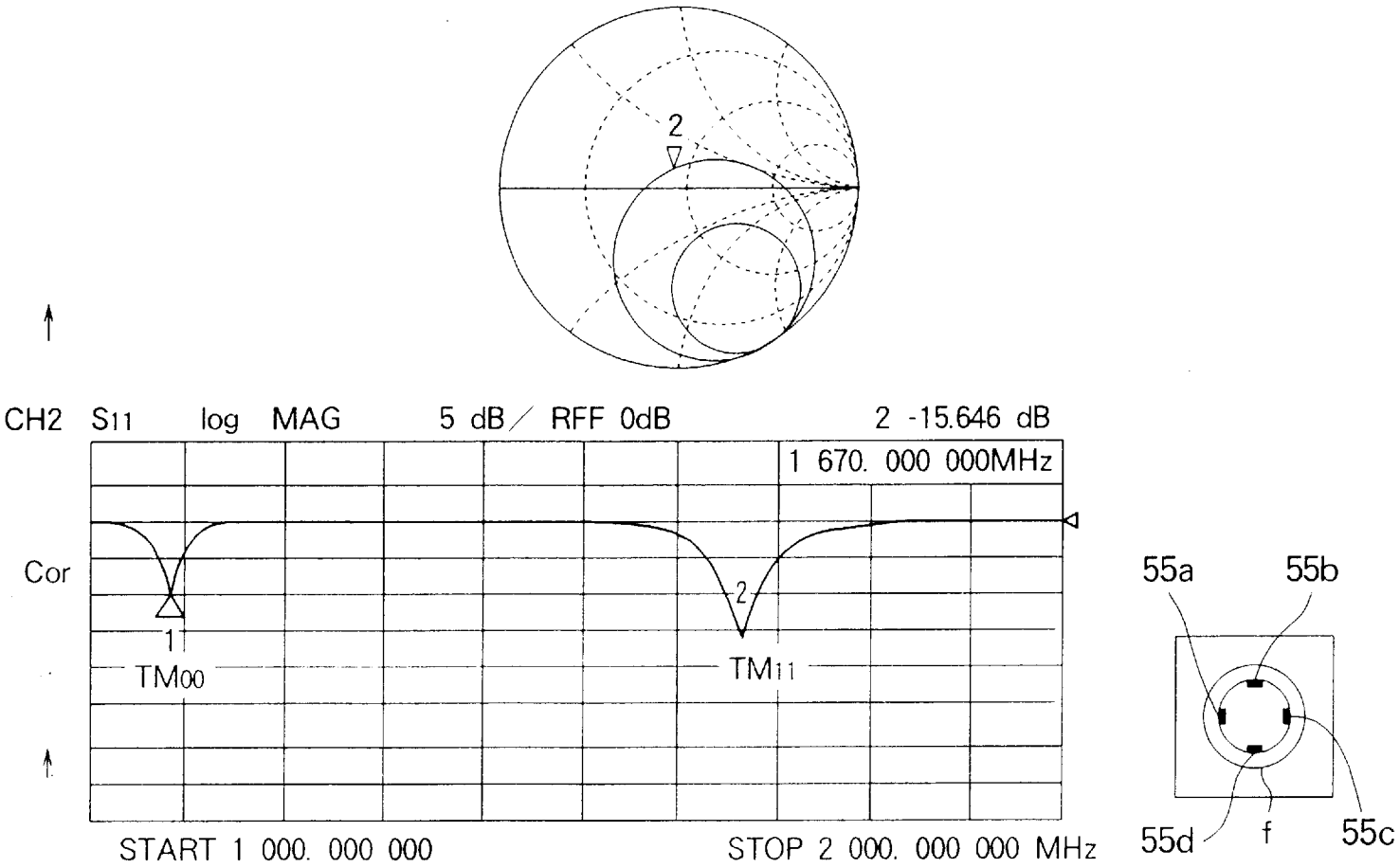
FIG. 25 is a graph showing a fifth example of the circularly polarized wave characteristics of the circle-annular patch antenna of FIG. 17.

FIG. 23 shows a resonance frequency in the case that the inside of the circle-annular patch antenna is shortcircuited at one point of a conductor 55*d* (width W=2 mm). FIG. 24 shows a resonance frequency in the case that the inside of the circle-annular patch antenna is shortcircuited at two points of conductors 55*a* and 55*d* (width W=2 mm). FIG. 25 shows resonance frequencies in the case that the inside of the circle-annular patch antenna is shortcircuited at four points of conductor 55*a*, 55*b*, 55*c*, and 55*d* (width W=2 mm). The angle of each shortcircuit plate is 90 degrees. The resonance frequencies are 1.57 GHz and 1.67 GHz. In FIG. 25, the lower frequency is a resonance frequency in $TM_{00}$ mode and the higher frequency (1.67 GHz) is a resonance frequency in dominant mode used for the conventional circular patch antenna. Measurement results show that the resonance frequency is proportional to the number of shortcircuit portions. The resonance frequencies of these constructions are in the middle of the resonance frequency of the above-described circle-annular patch antenna and the response frequency in the case that the inside is fully shortcircuited. In other words, when the inside of the circle-annular patch antenna is partially shortcircuited, an antenna with the size and gain equivalent to those of the conventional circular patch antenna can be accomplished.

Figure 26:
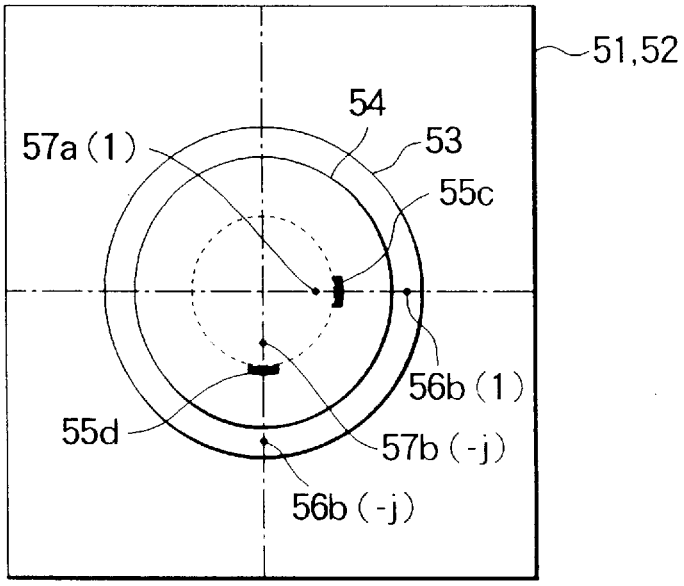
FIG. 26 is a plan view showing a first example of a feeding relation between a circle-annular patch and a circular patch of the circle-annular patch antenna of FIG. 17.
Figure 27:
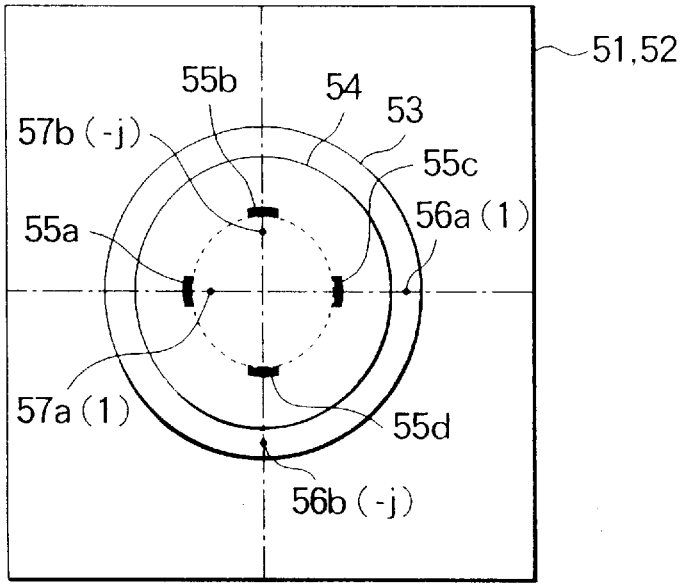
FIG. 27 is a plan view showing a second example of the feeding relation between a circle-annular patch and a circular patch of the circle-annular patch antenna of FIG. 17.

Thus, as shown in FIG. 26, a circularly polarized wave can be accomplished in the following construction. Signals are fed to two points 56*a* and 56*b* with a phase difference of 90 degrees. A circular patch antenna 54 is layered on the circle-annular patch antenna 53. Signals are fed to two points 57*a* and 57*b* with a phase difference of 90 degrees of the circular patch. In addition, since the resonance frequencies of the circle-annular patch antenna element and the circular patch antenna element can be freely selected, the antenna can be used as a two-frequency antenna. Since each of the shortcircuit portions has a width W, the fringing effect inside the circle-annular patch antenna 53 against the center cores of the coaxial lines 57*a* and 57*b* that feed signals to the circular patch can be suppressed. Moreover, in the construction of two-point feeding system with a phase difference of 90 degrees, as shown in FIG. 27, even if the feed positions of signals fed to circle-annular patch antenna and the circular antenna are changed, the same effects can be obtained.

Figure 28:
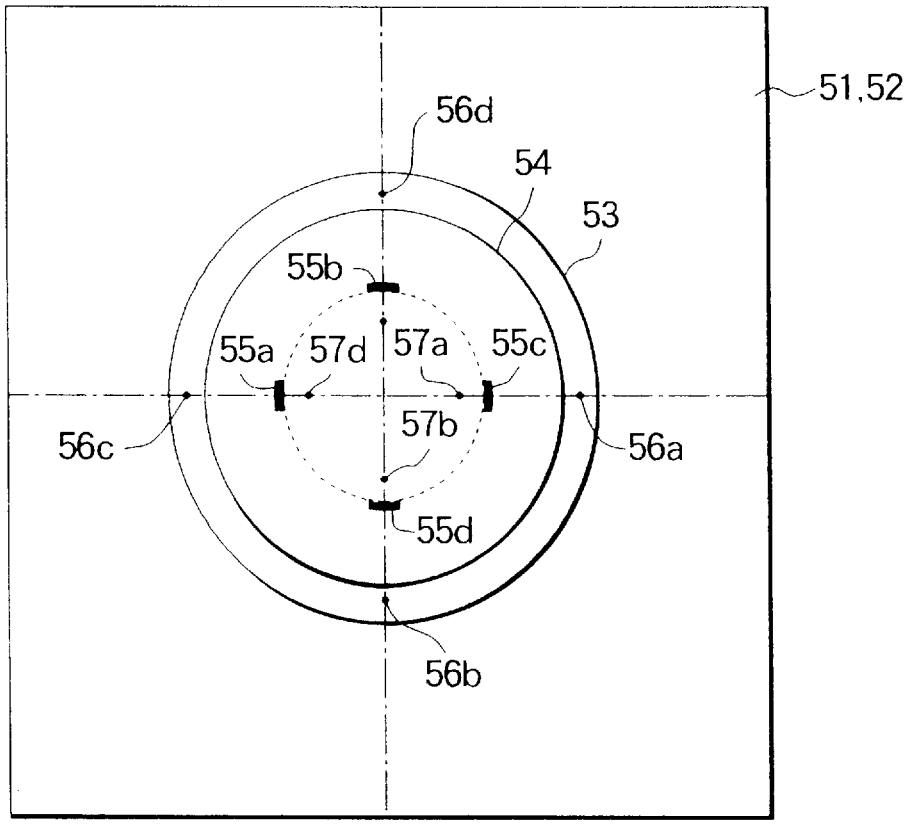
FIG. 28 is a plan view showing a third example of the feeding relation between a circle-annular patch and a circular patch of the circle-annular patch antenna of FIG. 17.

Furthermore, as shown in FIG. 28, even if signals are fed to four points with a phase difference of 90 degrees of the circle-annular patch antenna and the circular patch antenna, the same effects can be obtained.

Figure 29:
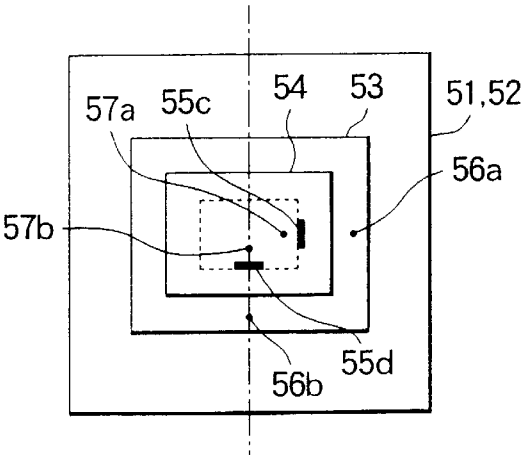
FIG. 29 is a plan view showing a fourth modification of the present invention.
Figure 30:
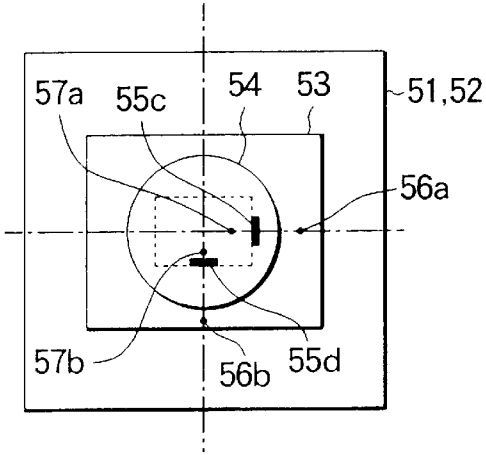
FIG. 30 is a plan view showing a fifth modification of the present invention.
Figure 31:
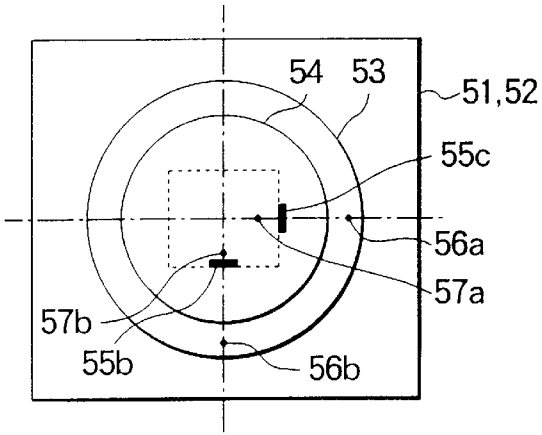
FIG. 31 is a plan view showing a sixth modification of the present invention.
Figure 32A:
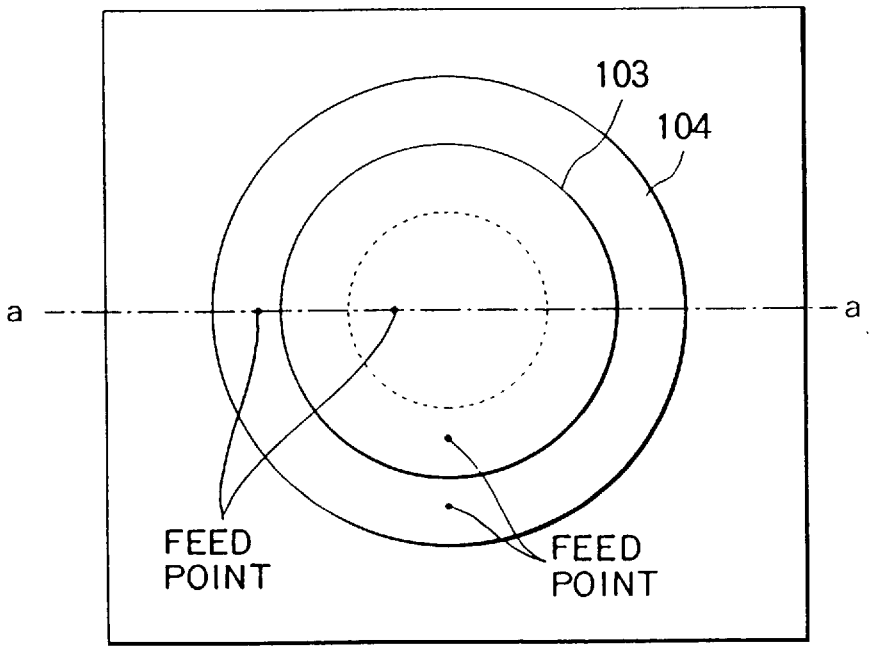
FIG. 32a PRIOR ART
FIGS. 32*a* and 32*b* are a plan view and a vertical sectional view, respectively, showing a conventional antenna.
Figure 32B:
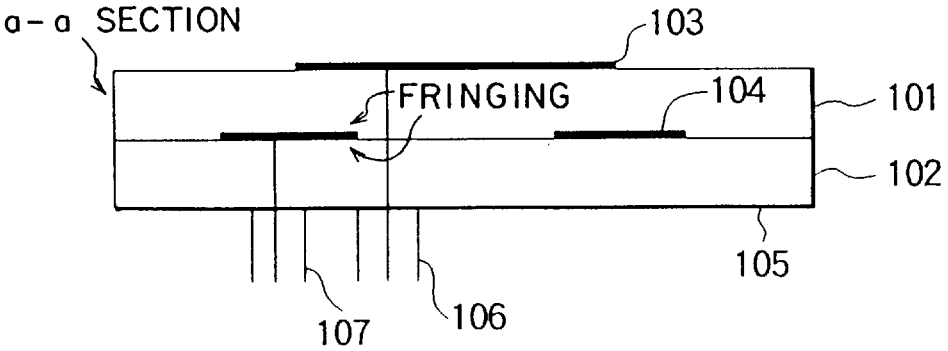
FIG. 32b PRIOR ART
Figure 33A:
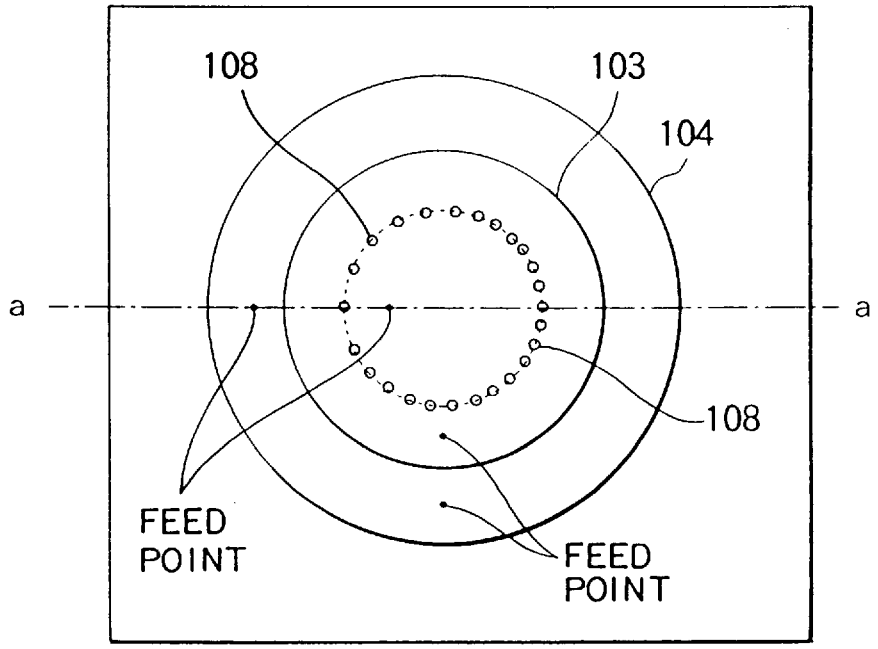
FIG. 33a PRIOR ART
FIGS. 33*a* and 33*b* are a plan view and a vertical sectional view, respectively, showing a conventional antenna.
Figure 33B:
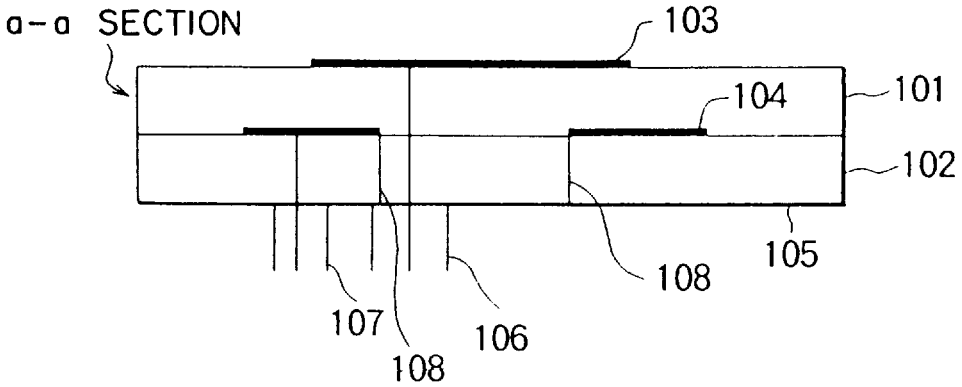
FIG. 33b PRIOR ART
Figure 34A:
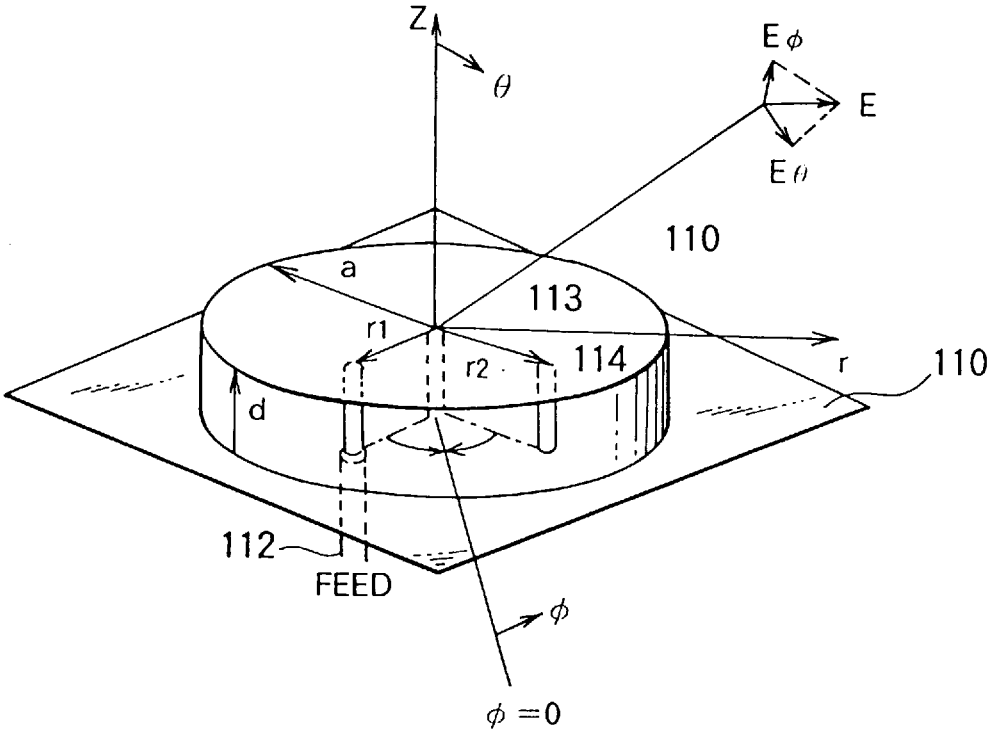
FIG. 34a PRIOR ART
FIGS. 34*a* and 34*b* are a plan view and a vertical sectional view, respectively, showing a conventional antenna.
Figure 34B:
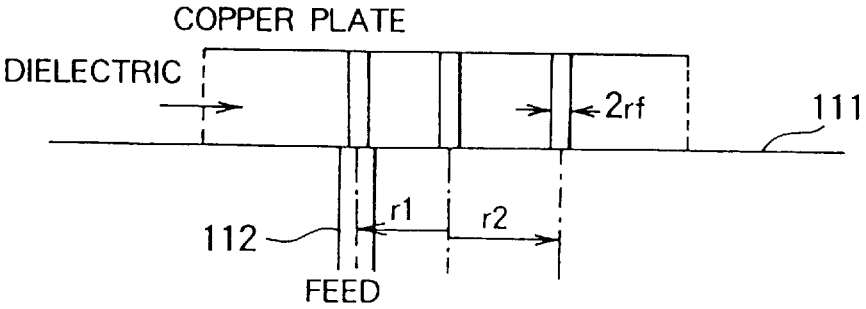
FIG. 34b PRIOR ART

FIGS. 29 to 31 show modifications of the above-described embodiments. The shapes of the patches according to the present invention are not limited to circular. Instead, the shapes of the patches may be rectangular, square, elliptic, and the like. In addition, the shapes of the inside and the outside is not limited. Moreover, instead of coaxial lines that feed signals to the circle-annular patch and the circular patch, a conventional electromagnetic coupling power feed method such as a slot coupling method using microstrip lines may be used.

As described above, according to the present invention, the antenna including the feeder circuit can be compactly and thinly constructed. With one point feeding, a circularly polarized wave can be generated. In addition, since the pitch between each antenna element can be decreased, a wide angle beam scanning operation can be performed. Thus, the antenna according to the present invention is suitable for a mobile-satellite communication.

When a circular patch antenna is layered on a circle-annular patch antenna, signals can be transmitted and received at the same time. Thus, the thickness of the substrate of the antenna can be reduced and thereby the weight of the antenna can be reduced.

Furthermore, since the fringing effect caused by coaxial lines that feed signals to a lower circle-annular antenna and an upper circular patch is suppressed, good circularly polarized wave characteristics of both the transmission antenna and the reception antenna can be accomplished.

In addition, since shortcircuit pins that shortcircuit a conductor inside a circle-annular patch and a ground conductor can be remarkably reduced, thereby remarkably reducing the fabrication cost.

Although the present invention has been shown and described with respect to best mode embodiments thereof, it should be understood by those skilled in the art that the foregoing and various other changes, omissions, and additions in the form and detail thereof may be made therein without departing from the spirit and scope of the present invention.

What is claimed is:

1. An antenna, comprising:

a dielectric substrate composed of a laminate of a plurality of substrate members, the dielectric substrate having first and second surfaces and a first laminate surface;

a first patch formed on the first surface of said dielectric substrate;

a second patch annularly formed on the first laminate surface of said dielectric substrate, the second patch having a center point with an inner periphery and an outer periphery surrounding the center point;

a ground conductor formed on the second surface of said dielectric substrate;

a first feeder portion for feeding a signal to a first position of said second patch;

a first shortcircuit portion connected between a second position and said ground conductor, the second position being located on the inner periphery of said second patch co-linear with and between the center point of said second patch and the first position;

a second shortcircuit portion connected between a third position on the inner periphery of said second patch and said ground conductor, the first and second shortcircuit portions having an electrically large width along the inner periphery of said second patch sufficient to control a resonance frequency of said antenna; and a second feeder portion connected to said first patch and adapted for feeding a signal to a fourth position at least one of co-linear with and between the center point of said second patch and the second position and co-linear with and between the center point of said second patch and the third position.

2. The antenna as set forth in claim 1, wherein said first patch is formed in a circle shape and said second patch is formed in a circle-annulus shape, said second patch being coaxial to said first patch.

3. The antenna as set forth in claim 1, wherein said second feeder portion is disposed on the fourth position either co-linear with and between the center point of said second patch and the second position or co-linear with and between the center point of said second patch and the third position, a notch for generating a circularly polarized wave being formed on said first patch.

4. The antenna as set forth in claim 1, further comprising:

a third feeder portion for feeding a signal to a fifth position of said second patch, the fifth position co-linear with and between the center point of said second patch and the third position.

5. The antenna as set forth in claim 1, further comprising:

a third shortcircuit portion connected at least between a position opposite to the second position on the inner periphery of said second patch and said ground conductor and between a position opposite to the third position on the inner periphery of said second patch and said ground conductor and having an electrically large width along the inner periphery of said second patch sufficient to control a resonance frequency of said antenna.

* * * * *